US010381786B2

(12) United States Patent
Nakamura

(10) Patent No.: US 10,381,786 B2
(45) Date of Patent: Aug. 13, 2019

(54) CONNECTOR

(71) Applicant: JAPAN AVIATION ELECTRONICS INDUSTRY, LIMITED, Tokyo (JP)

(72) Inventor: Keisuke Nakamura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/118,698

(22) Filed: Aug. 31, 2018

(65) Prior Publication Data

US 2019/0131747 A1 May 2, 2019

(30) Foreign Application Priority Data

Oct. 31, 2017 (JP) ..... 2017-210983

(51) Int. Cl.

| | |
|---|---|
| ***H01R 9/05*** | (2006.01) |
| ***H01R 13/6593*** | (2011.01) |
| ***H01R 13/6581*** | (2011.01) |
| ***H01R 24/28*** | (2011.01) |
| *H01R 103/00* | (2006.01) |
| *H01R 13/405* | (2006.01) |

(52) U.S. Cl.

CPC ..... *H01R 13/6593* (2013.01); *H01R 13/6581* (2013.01); *H01R 24/28* (2013.01); *H01R 13/405* (2013.01); *H01R 2103/00* (2013.01)

(58) Field of Classification Search

CPC ..... H01R 13/6593; H01R 2103/00; H01R 13/6315; H01R 24/28

USPC ..... 439/581

See application file for complete search history.

(56) References Cited

U.S. PATENT DOCUMENTS

| | | | | |
|---|---|---|---|---|
| 5,619,237 | A * | 4/1997 | Inoue | B41J 2/17503 347/86 |
| 2003/0206210 | A1* | 11/2003 | Nakamura | B41J 2/01 347/30 |
| 2008/0113557 | A1* | 5/2008 | Cox | H01R 31/06 439/607.05 |
| 2008/0124951 | A1* | 5/2008 | Cox | H01R 13/6315 439/65 |
| 2012/0056955 | A1* | 3/2012 | Kodama | B41J 2/1752 347/86 |

FOREIGN PATENT DOCUMENTS

| | | |
|---|---|---|
| JP | H09-120870 A | 5/1997 |
| JP | 2001-126812 A | 5/2001 |
| JP | 2015-125963 A | 7/2015 |

* cited by examiner

*Primary Examiner* — Jean F Duverne

(74) *Attorney, Agent, or Firm* — Collard & Roe, P.C.

(57) ABSTRACT

A connector has a fitting portion and a cable holding portion. The connector is provided with a signal terminal, a holding member, a cable fixing member and a lower shell. The holding member holds the signal terminal, and the lower shell is attached to the holding member. A cable receiving portion of the lower shell forms the cable holding portion at least in part, and a grounding connection portion forms the fitting portion at least in part. The cable fixing member is fixed to the cable receiving portion, and a cable extends in an intersecting direction from the cable receiving portion. In the intersecting direction, a clamp portion overlaps with the fitting portion.

9 Claims, 22 Drawing Sheets

CONNECTOR

CROSS REFERENCE TO RELATED APPLICATIONS

This application is based on and claims priority under 35 U.S.C. § 119 to Japanese Patent Application No. JP2017-210983 filed Oct. 31, 2017, the contents of which are incorporated herein in their entireties by reference.

BACKGROUND OF THE INVENTION

This invention relates to a connector.

There is known a connector which is attached to an end of a cable to be used and mateable with a mating connector. The connector of this type is described in, for example, JP2001-126812A (Patent Document 1).

As shown in FIG. 42, a connector 90 of Patent Document 1 is attached to an end of a cable 95. The connector 90 is mateable with a mating connector 97 in a front-rear direction (or a mating direction). In detail, the connector 90 has a fitting portion 901 to be mated with the mating connector 97 and a cable holding portion 903 holding the cable 95. The cable holding portion 903 is located rearward of the fitting portion 901, and the cable 95 is laid rearward thereof along the front-rear direction. Thus, in the connector 90 of Patent Document 1, the mating direction and a laid direction of the cable 95 are identical with each other.

SUMMARY OF THE INVENTION

In the case where the mating direction and the laid direction of the cable are identical with each other, the cable extends rearward of the connector in a state that the connector and the mating connector are mated with each other. Accordingly, a space behind the connector becomes a dead space inevitably. Therefore, there is a request to enable to use the space behind the connector effectively by changing the laid direction of the cable into an intersecting direction intersecting with the mating direction. In addition, in a case where the laid direction of the cable is changed into the intersecting direction, there is a request to reduce an increase of a size of the connector in the intersecting direction as much as possible.

Therefore, it is an object of the present invention to provide a connector which allows a space behind the connector to be effectively used and in which an increase of a size thereof is reduced in an intersecting direction intersecting with a mating direction thereof.

One aspect of the present invention provides a connector which is attachable to a cable having a signal conductor and a grounding conductor and which is mateable with a mating connector having a mating grounding member. The connector has a fitting portion and a cable holding portion located rearward of the fitting portion in a front-rear direction. The connector comprises a grounding member, a signal terminal, a holding member and a cable fixing member. The signal terminal is to be connected to the signal conductor. The holding member holds the signal terminal. The grounding member is attached to the holding member. The grounding member has a cable receiving portion and a grounding connection portion located forward of the cable receiving portion in the front-rear direction. The cable receiving portion forms at least a part of the cable holding portion. The grounding connection portion forms at least a part of the fitting portion. The grounding connection portion is to be connected to the mating grounding member when the connector is mated with the mating connector. The cable fixing member has a clamp portion clamping the grounding conductor. The cable fixing member is fixed to the cable receiving portion. The cable extends from the cable receiving portion in an intersecting direction intersecting with the front-rear direction. The cable fixing member connects the grounding conductor to the grounding member. The clamp portion overlaps with the fitting portion in the intersecting direction.

Clamping a cable by means of the cable fixing member ensures a sufficient force for holding the cable. Moreover, an increase of a size of the whole of the connector is reduced in the intersecting direction by forming the cable fixing member as a distinct body separated from the grounding member and fixing the cable fixing member to the grounding member so that the cable fixing member overlaps with the fitting portion. Thus, the connector can be obtained, wherein a laid direction of the cable is identical with the intersecting direction intersecting with the mating direction, and the increase of the size thereof in the intersecting direction is reduced.

An appreciation of the objectives of the present invention and a more complete understanding of its structure may be had by studying the following description of the preferred embodiment and by referring to the accompanying drawings.

Figure 1:
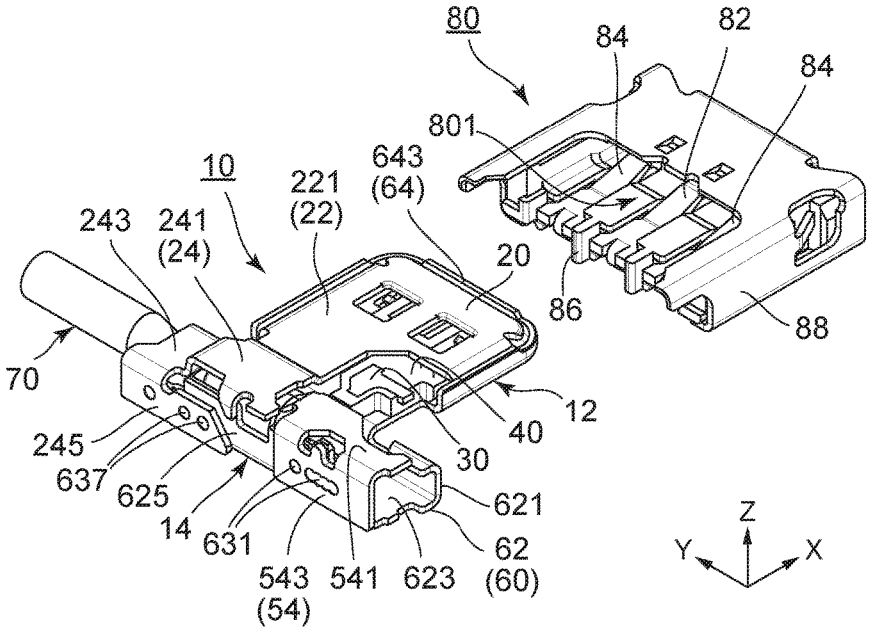
FIG. 1 is a perspective view showing a connector assembly having a connector according to a first embodiment of the present invention and a mating connector mateable with the connector. The connector and the mating connector are not yet mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
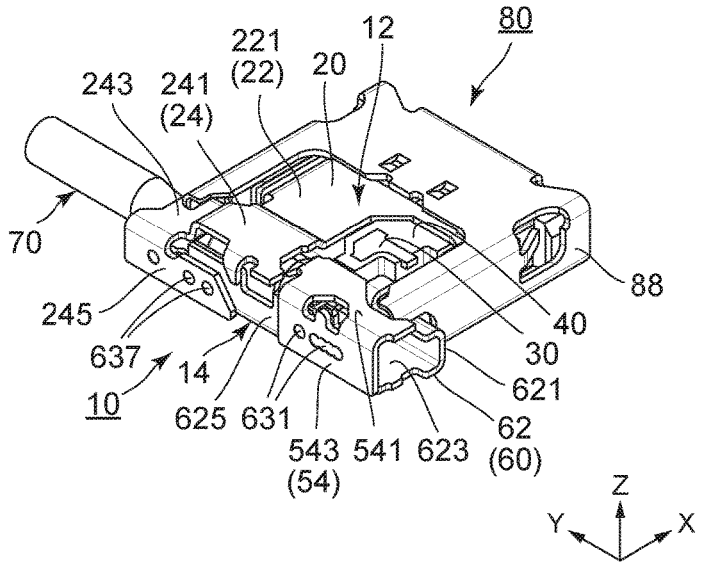
FIG. 2 is another perspective view showing the connector assembly of FIG. 1. The connector and the mating connector are mated with each other.

As understood from FIGS. 1 and 2, a connector 10 according to a first embodiment of the present invention is a connector mateable with a mating connector 80 along a mating direction. The connector 10 is attached to an end portion of a cable 70 when used. On the other hand, the mating connector 80 is mounted on, for example, a circuit board (not shown) when used.

As shown in FIG. 1, the mating connector 80 has a mating signal contact 82, a pair of mating grounding contacts (or mating grounding members) 84, a mating holding member 86 and a mating shell 88. The mating signal contact 82 and the mating grounding contacts 84 are held by the mating holding member 86. In the present embodiment, the mating signal contact 82 and the mating grounding contacts 84 are arranged in a lateral direction. In detail, the mating signal contact 82 is located between the mating grounding contacts 84 in the lateral direction. In the present embodiment, the lateral direction is a Y-direction. The mating shell 88 covers a periphery of the mating holding member 86 in part. The mating holding member 86 and the mating shell 88 form a receiving portion 801 to receive the connector 10 in part. In other words, the mating connector 80 has the receiving portion 801. Each of the mating signal contact 82 and the mating grounding contacts 84 is exposed in the receiving portion 801 in part. The mating signal contact 82 and the mating grounding contacts 84 are brought into contact with the connector 10 received by the receiving portion 801 when the connector 10 and the mating connector 80 are mated with each other.

As shown in FIG. 1, the connector 10 has a fitting portion 12 to be received by the receiving portion 801 of the mating connector 80 and a cable holding portion 14 located rearward of the fitting portion 12 in a front-rear direction. The front-rear direction is identical with the mating direction. In the present embodiment, the front-rear direction is an X-direction perpendicular to the lateral direction. The positive X-direction is directed forward while the negative X-direction is directed rearward.

Figure 8:
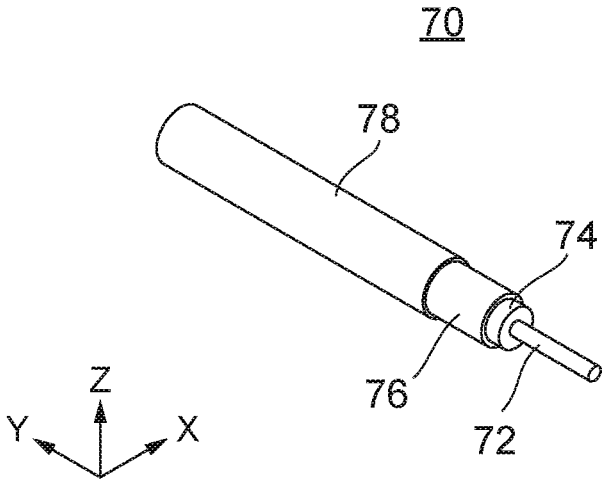
FIG. 8 is a perspective view showing an end portion of the cable to be attached to the connector main portion of FIG. 5.

As understood from FIG. 1, the cable holding portion 14 of the connector 10 holds the end portion of the cable 70. Referring to FIG. 8, the cable 70 has a central conductor (or a signal conductor) 72, an insulator 74, an outer conductor (or a grounding conductor) 76 and an outer sheath 78. As shown in FIG. 8, an end of the central conductor 72 and an end of the outer conductor 76 are exposed outside. The exposed part of the central conductor 72 and the exposed part of the outer conductor 76 are apart from each other in the lateral direction. In detail, the end of the central conductor 72 forms an end of the cable 70, and the end of the outer conductor 76 is apart from the end of the cable 70 (or the central conductor 72).

Figure 3:
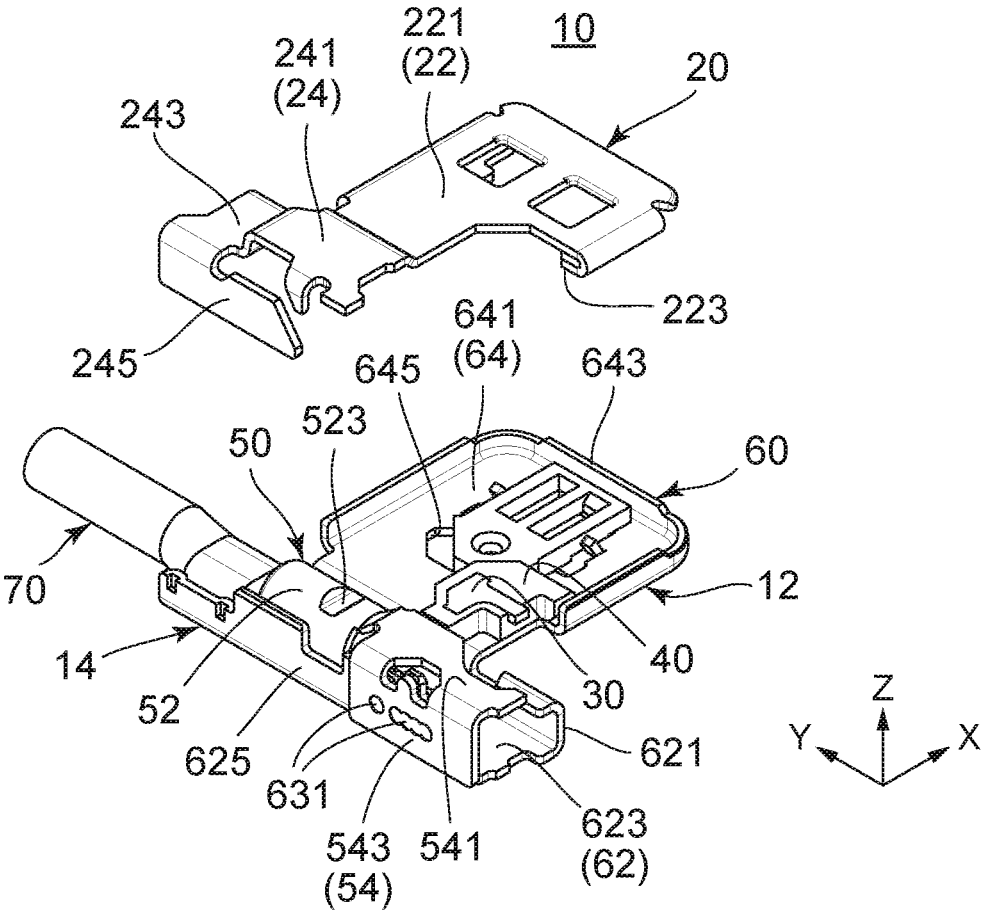
FIG. 3 is an exploded perspective view showing the connector included in the connector assembly of FIG. 1.
Figure 4:
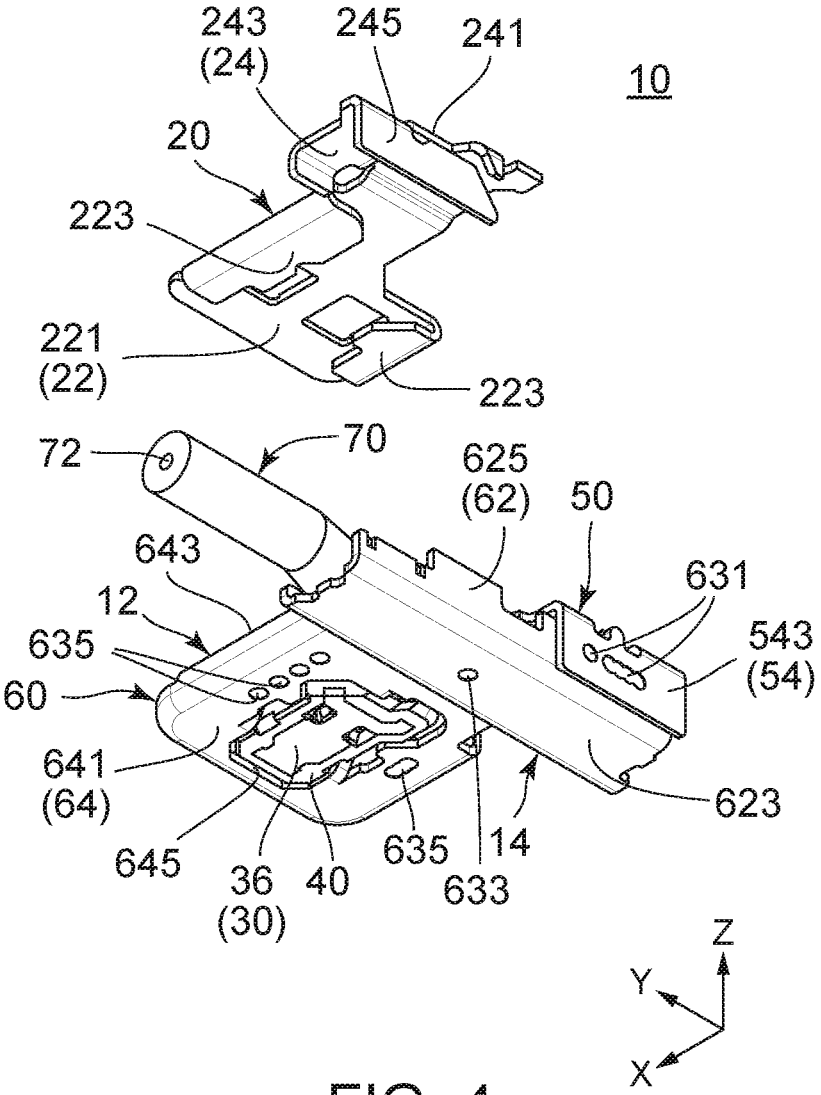
FIG. 4 is another exploded perspective view showing the connector of FIG. 3.

Referring to FIGS. 3 and 4, the connector 10 is provided with an upper shell 20, a signal terminal 30, a holding member 40, a cable fixing member 50 and a lower shell (or a grounding member) 60. In the present embodiment, the signal terminal 30, the holding member 40, the cable fixing member 50 and the lower shell (or the grounding member) 60 form a connector main portion.

Figure 9:
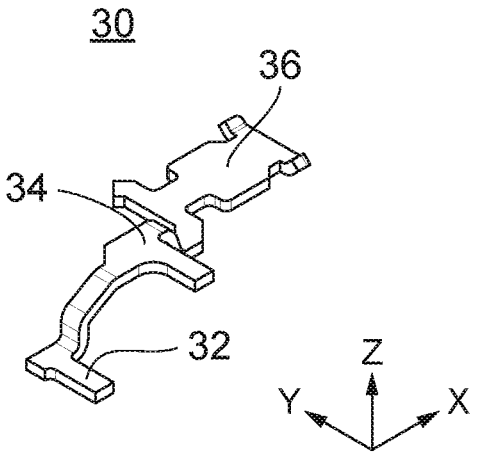
FIG. 9 is a perspective view showing a signal terminal included in the connector main portion of FIG. 5.
Figure 10:
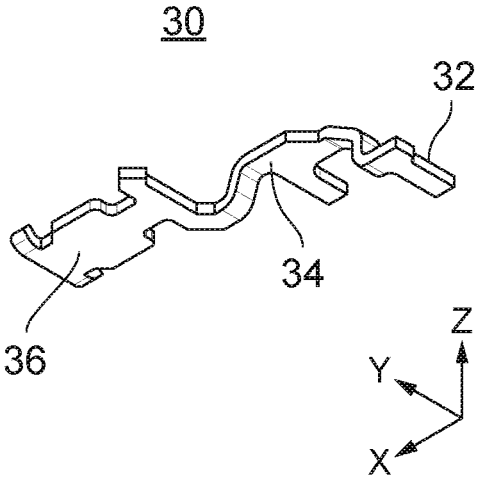
FIG. 10 is another perspective view showing the signal terminal of FIG. 9.

As shown in FIGS. 9 and 10, the signal terminal 30 has a connection portion 32, a coupling portion 34 and a contact portion 36. The connection portion 32 has a long shape in the lateral direction. The contact portion 36 has a long shape in the front-rear direction. The coupling portion 34 couples the connection portion 32 and the contact portion 36 to each other. The connection portion 32, the coupling portion 34 and the contact portion 36 are arranged in this order in the front-rear direction. The connection portion 32 is a part to which the end of the central conductor 72 (see FIG. 8) of the cable 70 is connected. The contact portion 36 is a part with which the mating signal contact 82 (see FIG. 1) is brought into contact when the connector 10 is mated with the mating connector 80 (see FIG. 2). The signal terminal 30 is formed by processing a single metal sheet.

Figure 11:
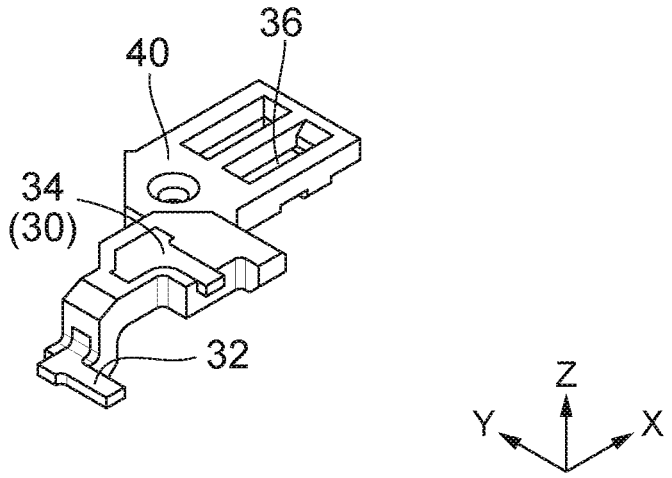
FIG. 11 is a perspective view showing a holding member included in the connector main portion of FIG. 5. The holding member holds the signal terminal of FIG. 9.
Figure 12:
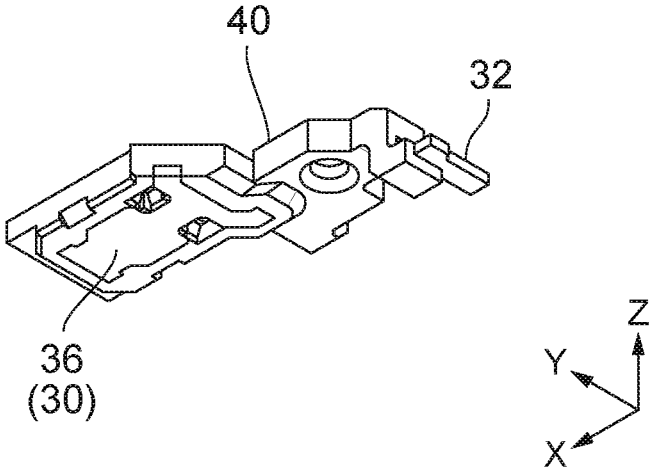
FIG. 12 is another perspective view showing the holding member of FIG. 11.

As shown in FIGS. 11 and 12, the holding member 40 has a shape corresponding to the signal terminal 30. The holding member 40 is integrally molded with the signal terminal 30 using insulating resin. Thus, the holding member 40 holds the signal terminal 30. In a state that the signal terminal 30 is held by the holding member 40, the connection portion 32 is exposed outside at least in part. In particular, an upper surface of the connection portion 32 is exposed outside. In this state, the contact portion 36 is also exposed outside at least in part. In particular, a lower surface of the contact portion 36 is exposed outside. In the present embodiment, an up-down direction is a Z-direction perpendicular to both of the front-rear direction and the lateral direction. The positive Z-direction is directed upward while the negative Z-direction is directed downward. The upper surface is a surface facing upward while the lower surface is a surface facing downward.

Figure 13:
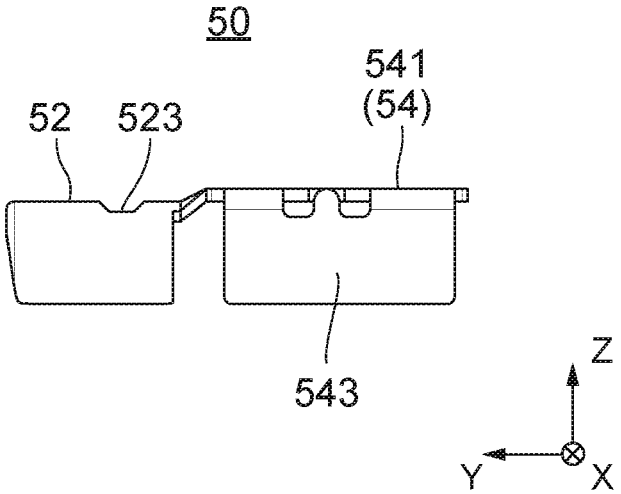
FIG. 13 is a rear view showing a cable fixing member included in the connector main portion of FIG. 5.
Figure 14:
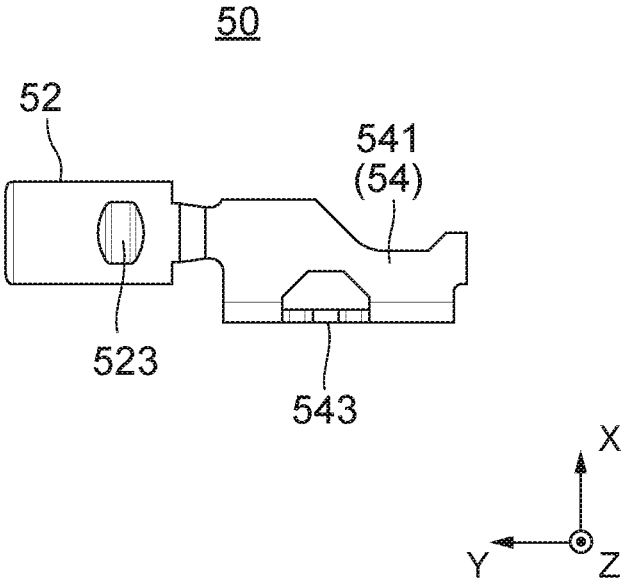
FIG. 14 is a plan view showing the cable fixing member of FIG. 13.
Figure 15:
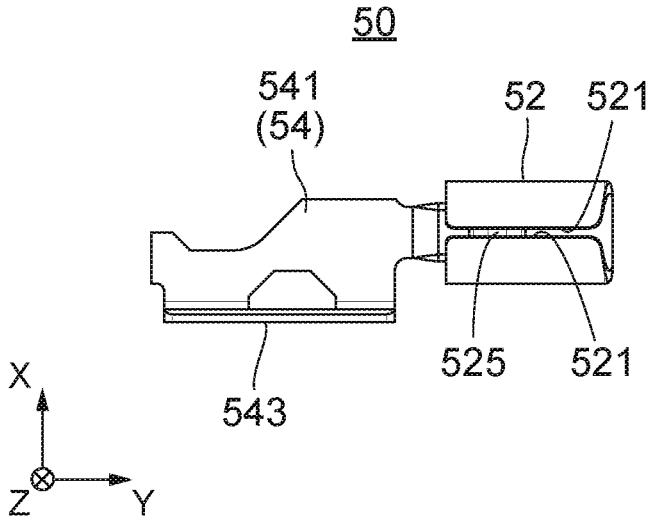
FIG. 15 is a bottom view showing the cable fixing member of FIG. 13.
Figure 16:
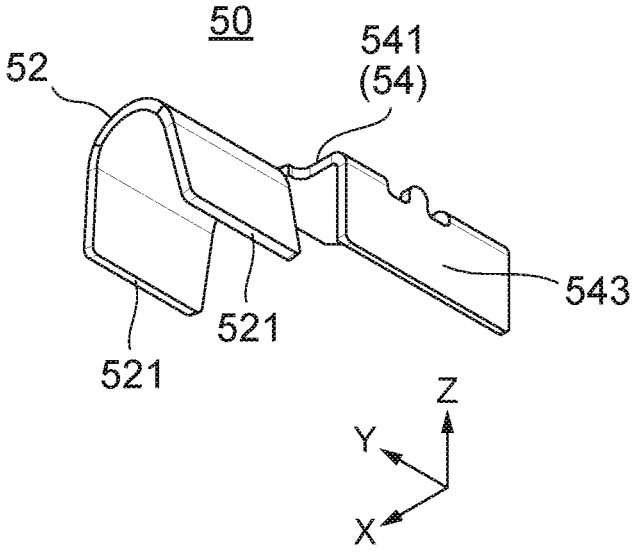
FIG. 16 is a perspective view showing the cable fixing member of FIG. 13.
Figure 17:
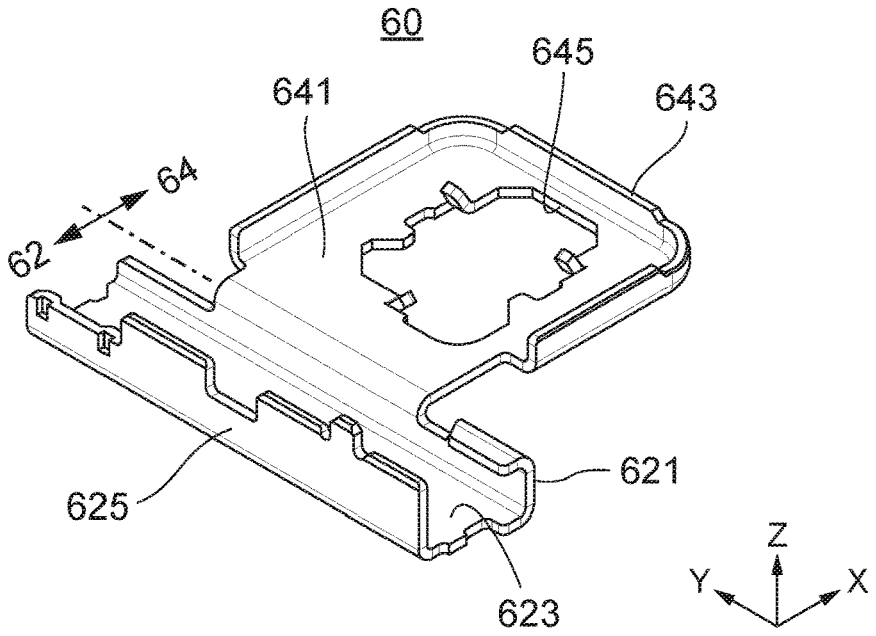
FIG. 17 is a perspective view showing a lower shell included in the connector main portion of FIG. 5.
Figure 18:
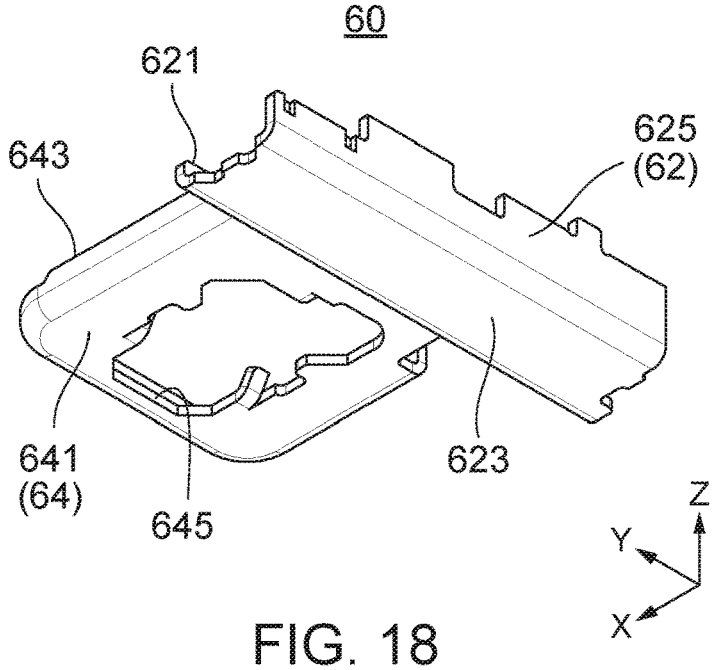
FIG. 18 is another perspective view showing the lower shell of FIG. 17.

As shown in FIGS. 13 to 15, the cable fixing member 50 has a clamp portion 52 and a fixed portion 54. However, the present invention is not limited thereto. The cable fixing member 50 may not have the fixed portion 54. The cable fixing member 50 is formed by processing a single metal sheet. The clamp portion 52 is bent into an approximately cylindrical shape to clamp the cable 70. As shown in FIG. 16, the clamp portion 52 has a shape like spread wings before it clamps the cable 70. As understood from FIGS. 13 to 15, in a state that the clamp portion 52 clamps the cable 70, end portions 521 of the clamp portion 52 are apart from each other and opposite to each other. In other words, the clamp portion 52 is formed to have no part overlapping with itself in the state that it clamps the cable 70. Accordingly, the clamp portion 52 can have a sufficient force for holding the cable 70.

As shown in FIGS. 13 and 14, an upper portion of the clamp portion 52 is formed with a hollow 523 dented downward in the up-down direction. The hollow 523 corresponds to a protruding portion 525 (see FIGS. 6 and 7) which is laid in an inner periphery of the clamp portion 52 to prevent the cable 70 from coming off.

As understood from FIGS. 5 to 8, the clamp portion 52 of the cable fixing member 50 clamps the exposed part of the outer conductor (or the grounding conductor) 76 of the cable 70. Here, the protruding portion 525 corresponding to the hollow 523 of the clamp portion 52 is directly brought into contact with the outer conductor 76. Accordingly, even when the clamp portion 52 clamps not only the exposed part of the outer conductor 76 but a part covered with the outer sheath 78, the clamp portion 52 clamps firmly the outer conductor 76 of the cable 70.

Referring to FIG. 3 in addition to FIGS. 13 and 14, the fixed portion 54 of the cable fixing member 50 has an upper plate portion 541 and a rear plate portion 543. When the fixed portion 54 is viewed along the lateral direction, the cable fixing member 50 has an L-shape.

As shown in FIGS. 17 to 21, the lower shell 60 has a cable receiving portion 62 and a grounding connection portion 64 located forward of the cable receiving portion 62 in the front-rear direction. The cable receiving portion 62 forms a part of the cable holding portion 14 (see FIG. 3 or FIG. 4) of the connector 10. Moreover, the grounding connection portion 64 forms at least a part of the fitting portion 12 (see FIG. 3 or FIG. 4) of the connector 10. As understood from FIGS. 1 and 2, in a state that the connector 10 is mated with the mating connector 80, the grounding connection portion 64 is received by the receiving portion 801. In this state, the grounding connection portion 64 is positioned above the mating grounding contacts 84 in the up-down direction. On the other hand, the cable receiving portion 62 is positioned rearward of the receiving portion 801 in the state that the connector 10 is mated with the mating connector 80.

As shown in FIGS. 17 to 21, the grounding connection portion 64 has a main plate 641 and an edge portion 643 formed along edges of the main plate 641. The edge portion 643 is continuously formed to both side edges of the main plate 641 in the lateral direction and to a front edge of the main plate 641. The edge portion 643 protrudes upward from the main plate 641.

As shown in FIGS. 17 to 20, the main plate 641 is formed with an opening 645, which penetrates the main plate 641 in the up-down direction at a central portion thereof. As understood from FIG. 6, the contact portion 36 of the signal terminal 30 held by the holding member 40 is located in the opening 645 at least in part. The lower surface of the contact portion 36 and a lower surface of the main plate 641 are substantially flush with each other. Accordingly, when the connector 10 is mated with the mating connector 80, the contact portion 36 of the signal terminal 30 is brought into contact with the mating signal contact 82 (see FIG. 1), and the main plate 641 is brought into contact with the mating grounding contacts 84 (see FIG. 1). Thus, the grounding connection portion 64 is connected to the mating grounding contacts 84 when the connector 10 is mated with the mating connector 80.

Figure 19:
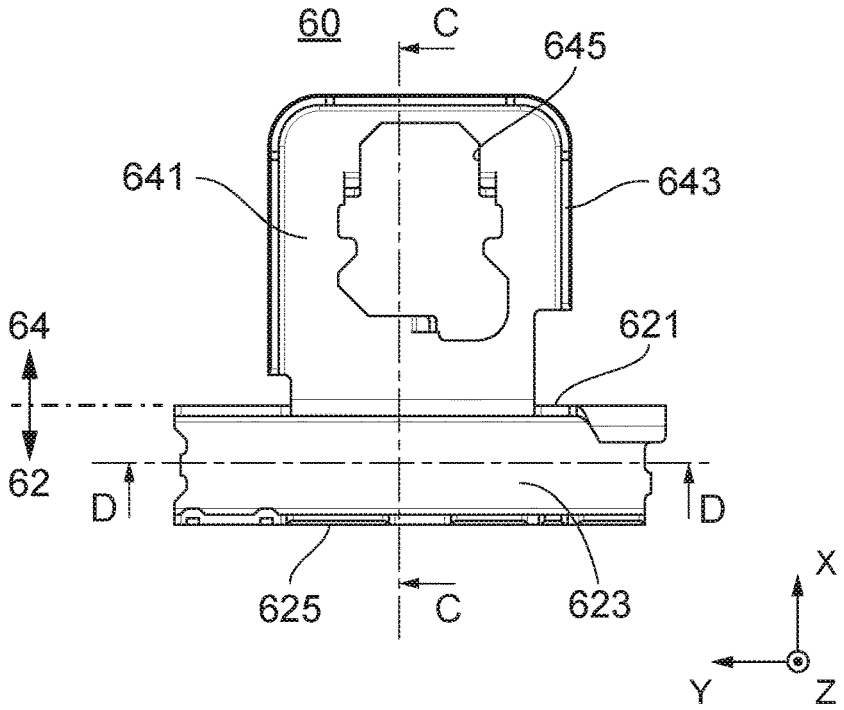
FIG. 19 is a plan view showing the lower shell of FIG. 17.

As understood from FIG. 19, the cable receiving portion 62 has a long shape in an intersecting direction intersecting with the front-rear direction. In other words, the cable receiving portion 62 extends in the intersecting direction. In the present embodiment, the intersecting direction is identical with the lateral direction. However, the present invention is not limited thereto. The intersecting direction may have an inclination with respect to the lateral direction.

Figure 20:
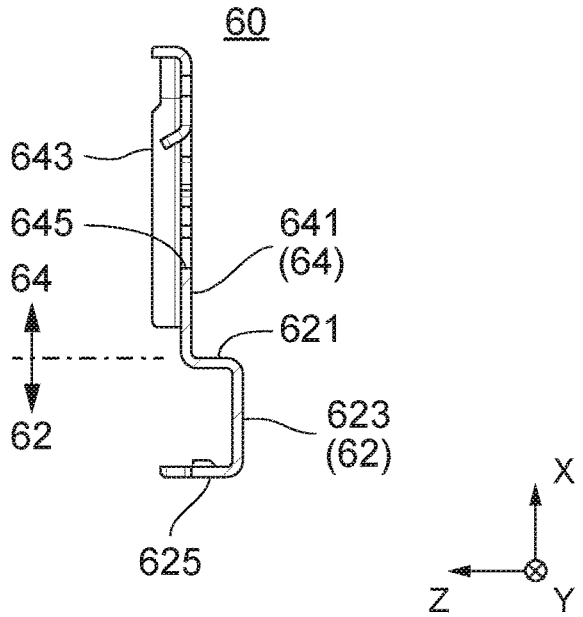
FIG. 20 is a cross-sectional view showing the lower shell of FIG. 19, taken along line C-C.
Figure 21:
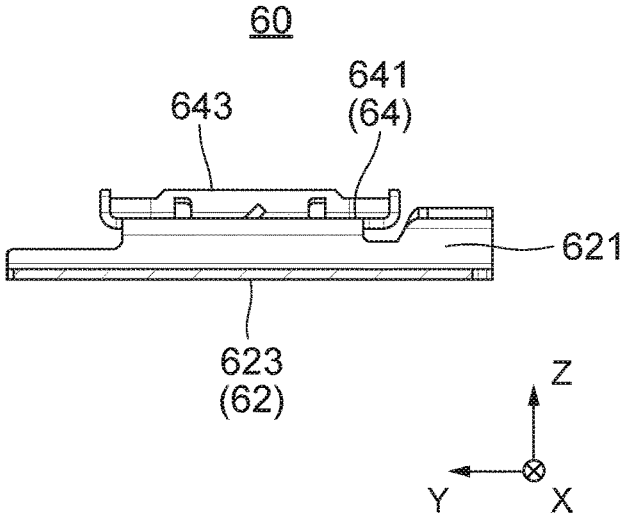
FIG. 21 is a cross-sectional view showing the lower shell of FIG. 19, taken along line D-D.

As shown in FIG. 20, the cable receiving portion 62 protrudes downward from the grounding connection portion 64. The cable receiving portion 62 is located downward of the main plate 641 except for a part thereof (or a part of a rear plate 625) in the up-down direction. The cable receiving portion 62 also has a cross section with a shape which opens upward in the up-down direction in a plane perpendicular to the intersecting direction. In the present embodiment, the cross-sectional shape of the cable receiving portion 62 is an angular C-shape. In detail, the cable receiving portion 62 has a front plate 621 extending downward from a rear edge of the grounding connection portion 64, a bottom plate 623 extending rearward from a lower edge of the front plate 621 and the rear plate 625 extending upward from a rear edge of the bottom plate 623. However, the present invention is not limited thereto. For example, the cross-sectional shape of the cable receiving portion 62 may be a semicircular shape or the like. Nevertheless, in terms of easiness of its fabrication, the cross-sectional shape of the cable receiving portion 62 is preferable to be the angular C-shape like that of the present embodiment.

Referring to FIGS. 3 to 7, the lower shell 60 is attached to the holding member 40. As understood from FIG. 4 particularly, the lower shell 60 covers a lower side of the holding member 40 at least in part in a state that it is attached to the holding member 40. Moreover, in the state that the lower shell 60 is attached to the holding member 40, the contact portion 36 of the signal terminal 30 held by the holding member 40 is exposed in the opening 645 of the lower shell 60 in part.

Figure 5:
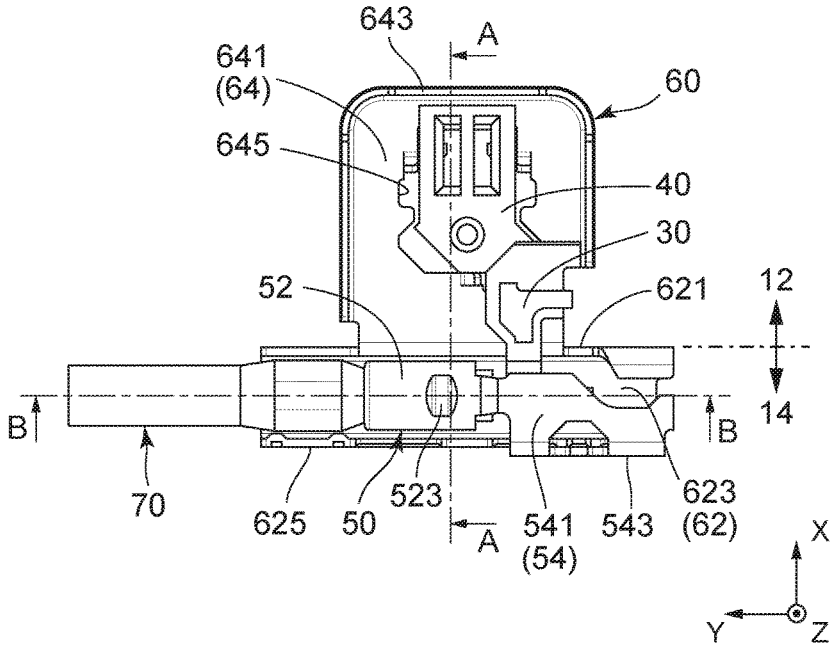
FIG. 5 is a plan view showing a connector main portion included in the connector of FIG. 3.

As shown in FIGS. 3 to 5, the cable fixing member 50 is attached to the cable receiving portion 62. In detail, the rear plate portion 543 (or the fixed portion 54) of the cable fixing member 50 is fixed to the rear plate 625 of the cable receiving portion 62. In the present embodiment, the rear plate portion 543 is located rearward of the rear plate 625 and spot-welded to the rear plate 625. As shown in FIGS. 3 and 4, a plurality of welding marks 631 is left on the rear plate 625. However, the present invention is not limited thereto. Fixation between the rear plate portion 543 and the rear plate 625 may be made by bonding or the like. In a case where the cable fixing member 50 does not have the fixed portion 54, the clamp portion 52 may be fixed to the cable receiving portion 62.

Figure 6:
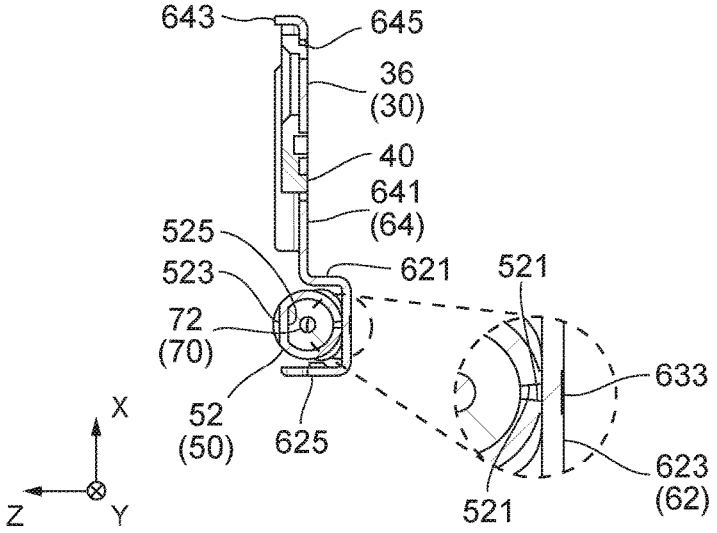
FIG. 6 is a cross-sectional view showing the connector main portion of FIG. 5, taken along line A-A. A cable is simplified in structure to be shown.
Figure 7:
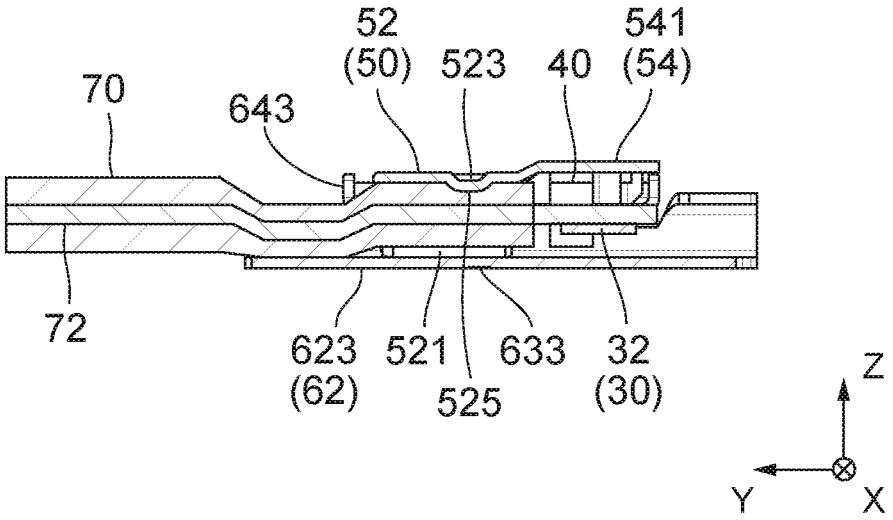
FIG. 7 is a cross-sectional view showing the connector main portion of FIG. 5, taken along line B-B. The cable is simplified in structure to be shown.

Referring to FIGS. 4, 6 and 7, on the bottom plate 623 of the cable receiving portion 62, a welding mark 633 is left. The welding mark 633 is caused by fixing the clamp portion 52 of the cable fixing member 50 to the bottom plate 623 of the cable receiving portion 62 by spot welding. That is, in the present embodiment, the clamp portion 52 is connected to a bottom portion of the cable receiving portion 62 and fixed to the cable receiving portion 62 at the connection place by welding. Thus, in the present embodiment, the clamp portion 52 is connected to the cable receiving portion 62 at a place located downward of the grounding connection portion 64 in the up-down direction.

As mentioned above, in the present embodiment, the cable fixing member 50 is attached to the cable receiving portion 62. As a result, the outer conductor (or the grounding conductor) 76 of the cable 70 and the lower shell (or the grounding member) 60 are electrically connected to each other to form electric paths therebetween. As understood from FIGS. 3 and 7, the electric paths between the outer conductor 76 (see FIG. 8) of the cable 70 and the lower shell 60 are two in number. A first path of the electric paths is a path which reaches the rear plate 625 of the lower shell 60 through the clamp portion 52 and the fixed portion 54. A second path of the electric paths is a path which reaches the bottom plate 623 of the lower shell 60 through the clamp portion 52. The second path is remarkably shorter than the first path. Accordingly, existence of the second path shortens the electric path between the outer conductor 76 and the mating grounding contacts 84 when the connector 10 is mated with the mating connector 80. As a result, the connector 10 of the present embodiment can provide good signal characteristics in comparison with a connector having no second path. Although the clamp portion 52 is connected to the bottom plate 623 in the present embodiment, the present invention is not limited thereto. The clamp portion 52 may be connected to the front plate 621 or the rear plate 625 of the cable receiving portion 62.

As understood from FIGS. 3 to 7, the end portion of the cable 70 is received in the cable receiving portion 62 by attaching the lower shell 60 to the holding member 40 and fixing the cable fixing member 50 to the cable receiving portion 62. In this manner, the cable 70 extends from the cable receiving portion 62 along the intersecting direction. In other words, the cable 70 extends in a direction different from the mating direction. As a result, the connector 10 can reduce a dead space remaining behind it in comparison with a connector in which a laid direction of a cable is identical with a mating direction thereof.

As understood from FIGS. 5 and 7, in a state that the cable fixing member 50 is fixed to the cable receiving portion 62, the clamp portion 52 overlaps with the main plate 641 of the grounding connection portion 64 in the intersecting direction. That is, the clamp portion 52 overlaps with the fitting portion 12 (see FIG. 3) in the intersecting direction. In other words, when viewed along the front-rear direction, the clamp portion 52 is located inward of both ends of the main plate 641 of the grounding connection portion 64 in the lateral direction. This can be also said that both ends of the clamp portion 52 are positioned inward of both ends of the fitting portion 12 in the lateral direction. However, the present invention is not limited thereto. It is sufficient that the clamp portion 52 overlaps with the fitting portion 12 in the intersecting direction. Furthermore, it is sufficient that the clamp portion 52 is located inward of both ends of the cable receiving portion 62 in the intersecting direction. According to the present embodiment, since the cable fixing member 50 is distinct from the lower shell 60, a degree of design freedom regarding a position for clamping the cable 70 is high. Accordingly, an increase of the size of the whole of the connector 10 can be reduced by arranging the clamp portion 52 so that the clamp portion 52 overlaps with the fitting portion 12 in the intersecting direction.

As understood from FIGS. 1, 3, 4, 22 and 23, the upper shell 20 is combined with the lower shell 60. The upper shell 20 has a front portion 22 and a rear portion 24. The front portion 22 has an upper plate 221 and a lower plate 223. The upper plate 221 and the lower plate 223 continue to each other and substantially arranged in parallel to each other. The front portion 22 forms the fitting portion 12 of the connector 10 in part. The upper plate 221 of the front portion 22 covers an upper side of the holding member 40 at least in part. In the state that the upper shell 20 and the lower shell 60 are combined with each other, the lower plate 223 is fixed to the main plate 641 of the grounding connection portion 64. In the present embodiment, spot welding is used for this fixation. Accordingly, on the main plate 641 of the grounding connection portion 64, as shown in FIG. 4, a plurality of welding marks 635 is left. Moreover, the rear portion 24 forms the cable holding portion 14 of the connector 10 in part.

As shown in FIGS. 3 and 4, the rear portion 24 of the upper shell 20 has a covering portion 241, a cable fixing portion 243 and a rear plate portion 245. The covering portion 241 covers an upper side of the clamp portion 52 in part. As understood from FIG. 23, the cable fixing portion 243 fixes a part of the cable 70 that is covered by the outer sheath 78 (see FIG. 8) together with the cable receiving portion 62. As understood from FIGS. 1, 2 and 22, the rear plate portion 245 is fixed to the rear plate 625 of the cable receiving portion 62. In the present embodiment, the rear plate portion 245 is located rearward of the rear plate 625 and fixed to the rear plate 625 by spot welding. As shown in FIGS. 1 and 2, on the rear plate portion 245, a plurality of welding marks 637 is left.

Figure 22:
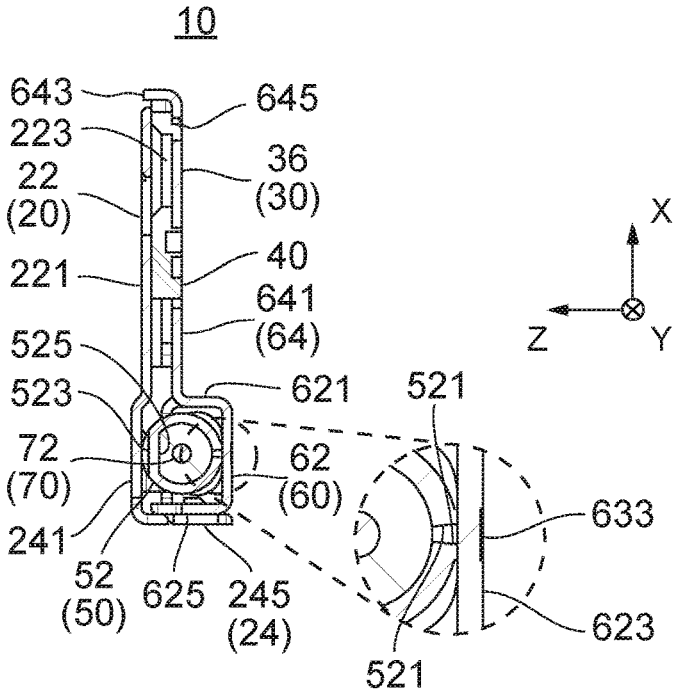
FIG. 22 is a cross-sectional view showing the connector of FIG. 3. The cross section illustrated corresponds to a cross section shown in FIG. 6. The cable is simplified in structure to be shown.
Figure 23:
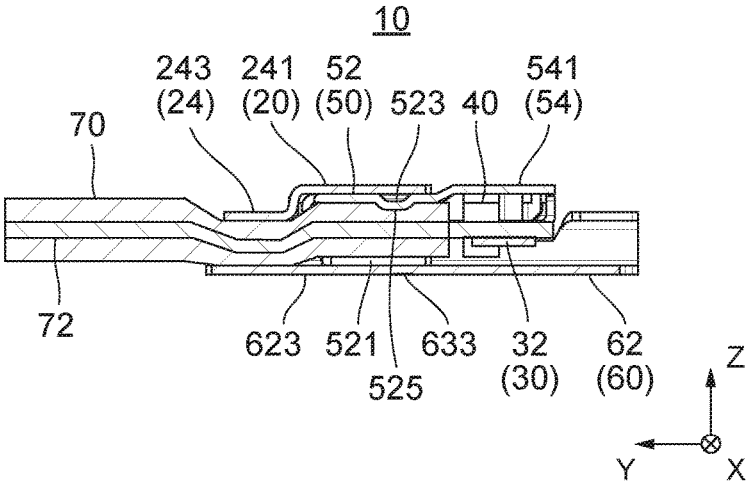
FIG. 23 is another cross-sectional view showing the connector of FIG. 3. The cross section illustrated corresponds to a cross section shown in FIG. 7. The cable is simplified in structure to be shown.
Figure 24:
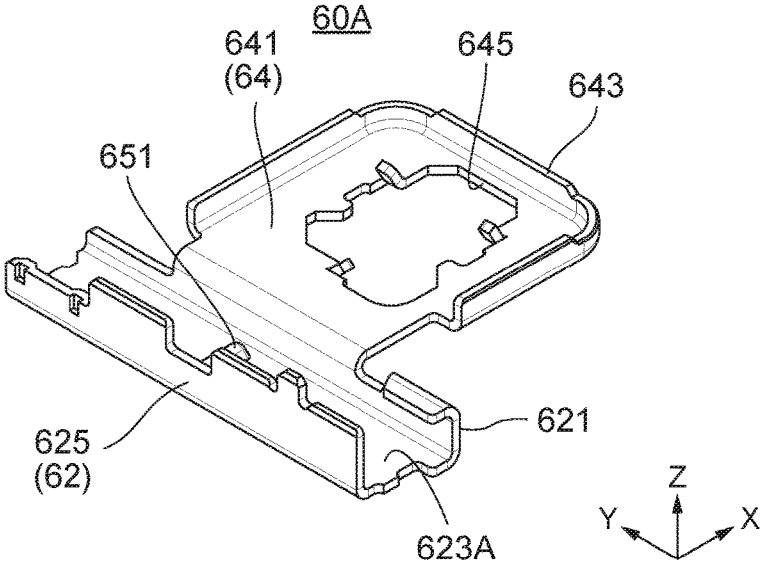
FIG. 24 is a perspective view showing a lower shell included in a connector according to a second embodiment of the present invention.
Figure 25:
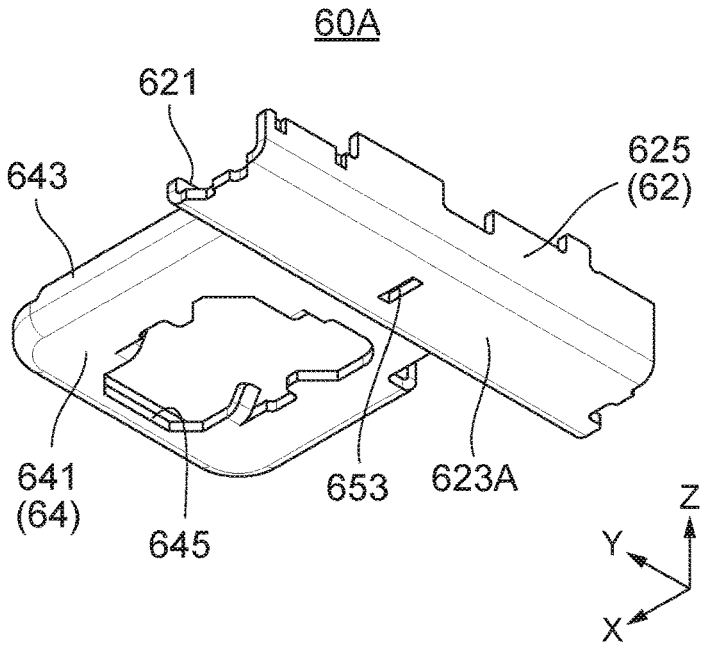
FIG. 25 is another perspective view showing the lower shell of FIG. 24.
Figure 26:
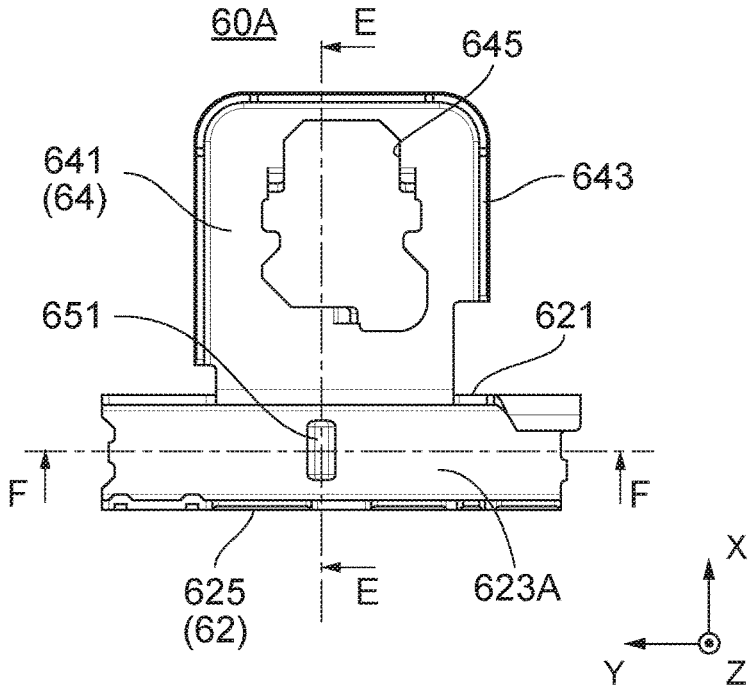
FIG. 26 is a plan view showing the lower shell of FIG. 24.
Figure 27:
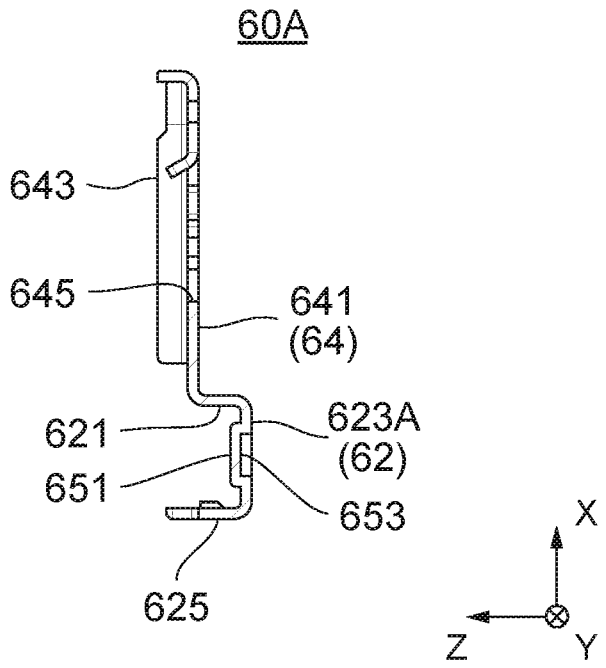
FIG. 27 is a cross-sectional view showing the lower shell of FIG. 26, taken along line E-E.
Figure 28:
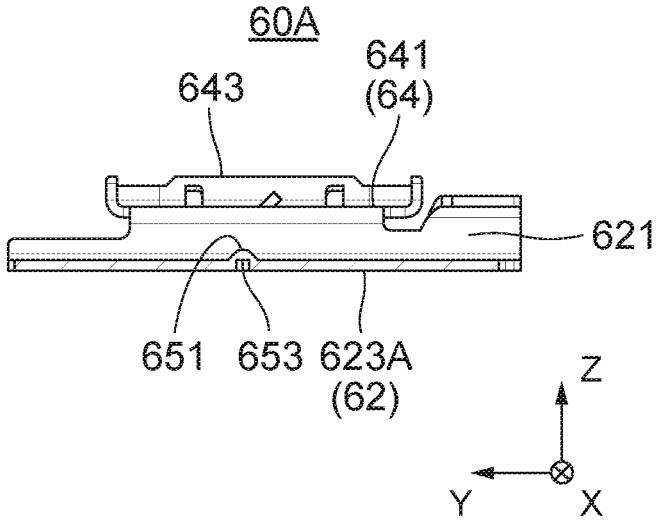
FIG. 28 is a cross-sectional view showing the lower shell of FIG. 26, taken along line F-F.

As understood from FIG. 22, in the connector 10 of the present embodiment, the center of the cable 70 is located downward of the middle of the fitting portion 12 (see FIG. 1) in the up-down direction. Accordingly, height of a part of the connector 10 that protrudes from the mating connector 80 can be reduced, preferably to none, in the up-down direction when the connector 10 and the mating connector 80 are mated with each other (see FIG. 2). As a result, height of the connector assembly consisting of the connector 10 and the mating connector 80 can be reduced. In the present embodiment, in the state that the connector 10 is mated with the mating connector 80, a topmost position of the connector 10 and a topmost position of the mating connector 80 are identical with each other in the up-down direction.

Second Embodiment

A connector according to a second embodiment of the present invention is provided with a lower shell 60A shown in FIGS. 24 to 28. Because other points of the connector are same as those of the connector 10 according to the first embodiment, the description of them is omitted.

Referring to FIGS. 24 to 28, the lower shell 60A has a protruding portion 651 formed to a bottom plate 623A of the cable receiving portion 62. The protruding portion 651 is formed by protruding the bottom plate 623A in part. A lower surface of the bottom plate 623A is formed with a recess portion 653 corresponding to the protruding portion 651.

Figure 29:
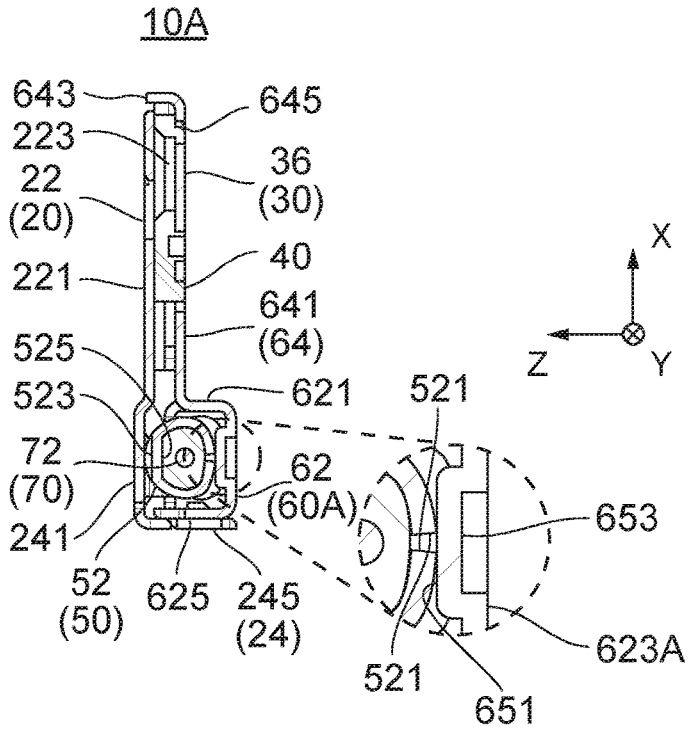
FIG. 29 is a cross-sectional view showing the connector including the lower shell of FIG. 27. An end portion of a clamp portion and its vicinity are enlarged to be shown. The cable is simplified in structure to be shown.
Figure 30:
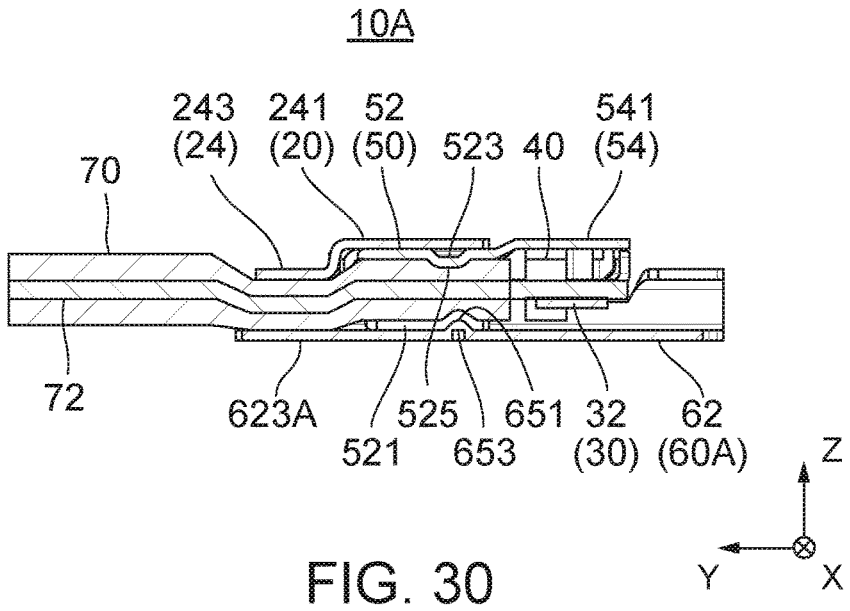
FIG. 30 is a cross-sectional view showing the connector including the lower shell of FIG. 28. The cable is simplified in structure to be shown.
Figure 31:
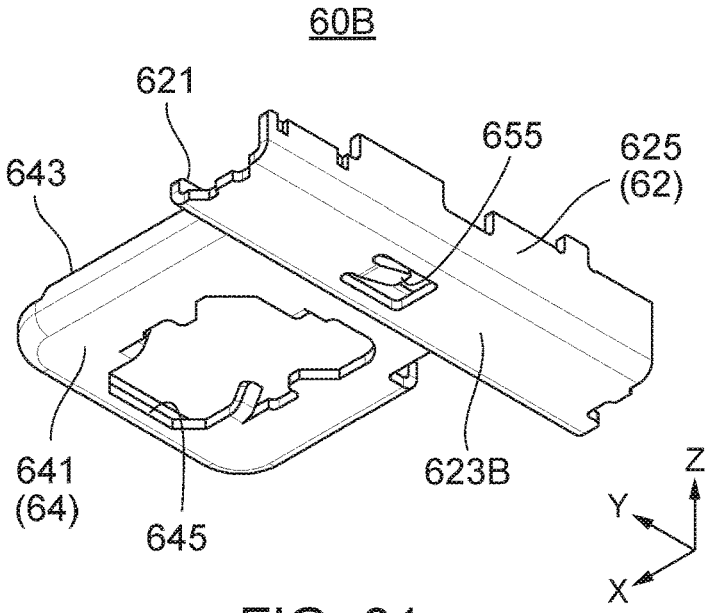
FIG. 31 is a perspective view showing a lower shell included in a connector according to a third embodiment of the present invention.
Figure 32:
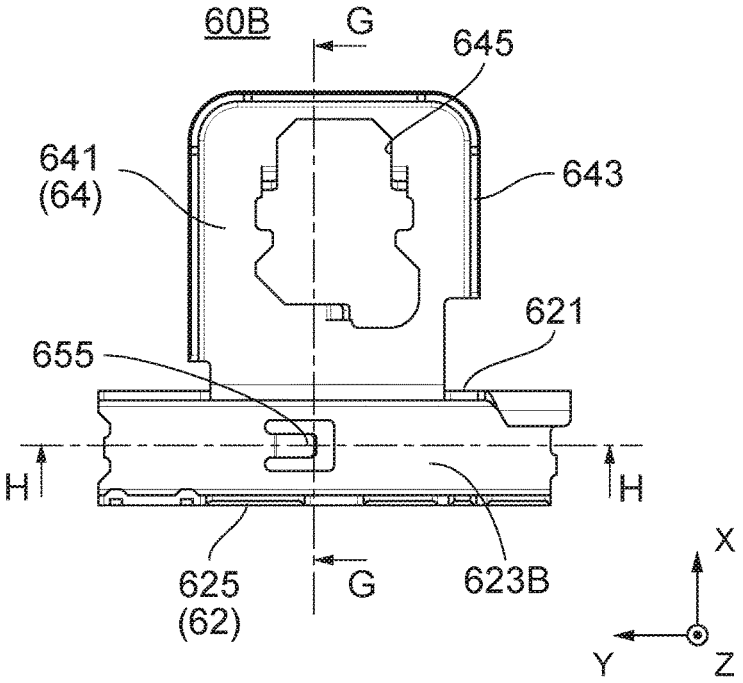
FIG. 32 is a plan view showing the lower shell of FIG. 31.
Figure 33:
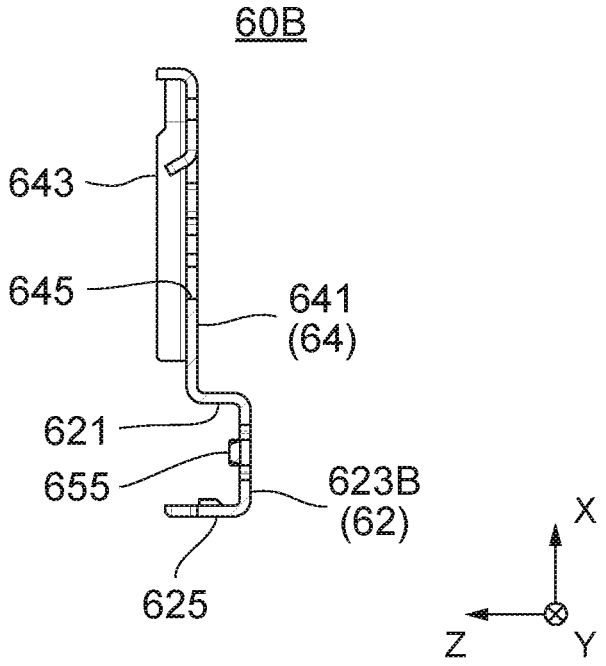
FIG. 33 is a cross-sectional view showing the lower shell of FIG. 32, taken along line G-G.
Figure 34:
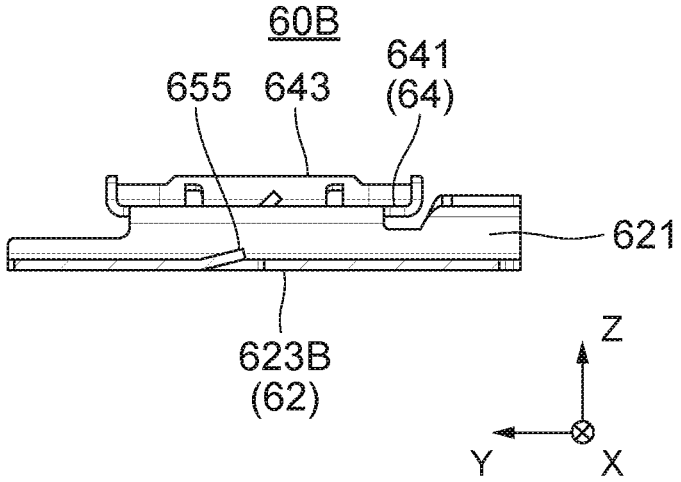
FIG. 34 is a cross-sectional view showing the lower shell of FIG. 32, taken along line H-H.

As understood from FIGS. 29 and 30, the protruding portion 651 is pressed against the clamp portion 52 when the cable fixing member 50 is attached to the cable receiving portion 62. In this event, the protruding portion 651 may be pressed against the clamp portion 52 by a force of a degree of deforming at least one of the protruding portion 651 and the clamp portion 52. Thus, the outer conductor (or the grounding conductor) 76 (see FIG. 8) of the cable 70 and the lower shell (or the grounding member) 60A are electrically connected to each other through the clamp portion 52. As a result, good signal transmission characteristics can be also obtained in the connector of the present embodiment.

Third Embodiment

A connector according to a third embodiment of the present invention is provided with a lower shell 60B shown in FIGS. 31 to 34. Because other points of the connector are same as those of the connector 10 according to the first embodiment, the description of them is omitted.

Referring to FIGS. 31 to 34, the lower shell 60B has a press portion 655 formed to a bottom plate 623B of the cable receiving portion 62. The press portion 655 is formed by applying cutting and bending processes to the bottom plate 623B. The press portion 655 is formed as a cantilever and resiliently deformable.

Figure 35:
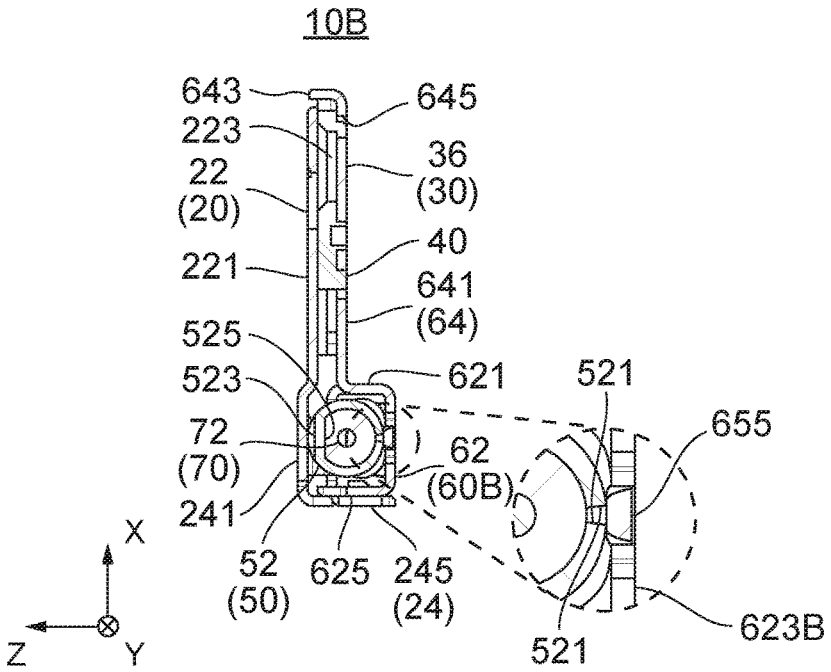
FIG. 35 is a cross-sectional view showing the connector including the lower shell of FIG. 33. An end portion of a clamp portion and its vicinity are enlarged to be shown. The cable is simplified in structure to be shown.
Figure 36:
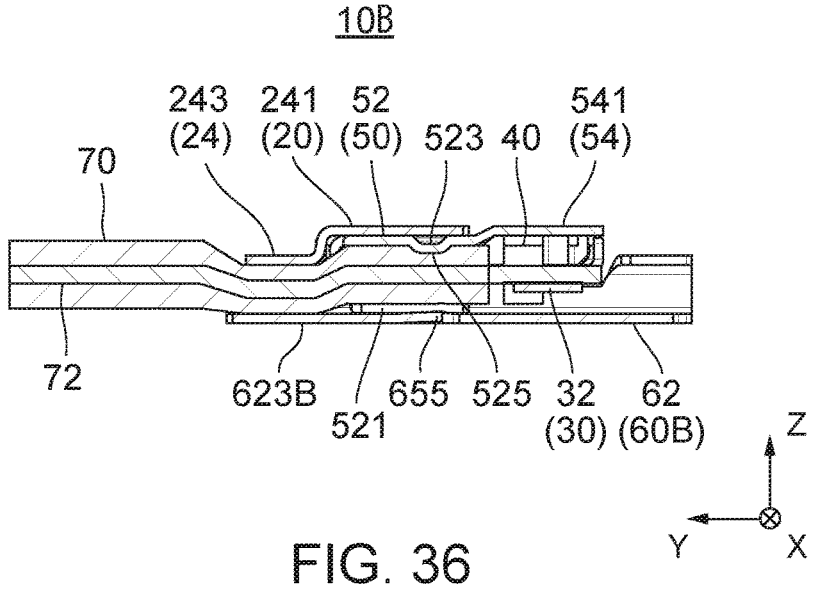
FIG. 36 is a cross-sectional view showing the connector included in the lower shell of FIG. 34. The cable is simplified in structure to be shown.
Figure 37:
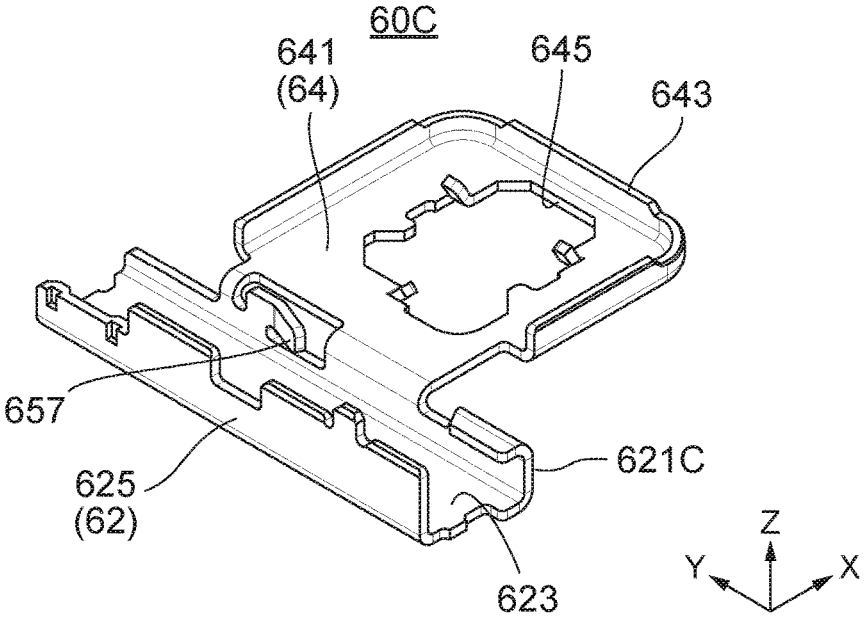
FIG. 37 is a perspective view showing a lower shell included in a connector according to a fourth embodiment of the present invention.
Figure 38:
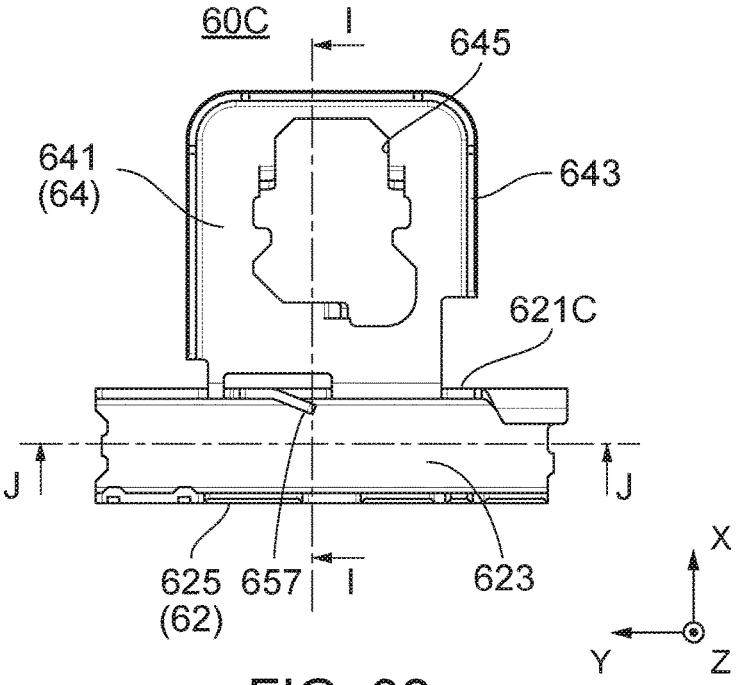
FIG. 38 is a plan view showing the lower shell of FIG. 37.
Figure 39:
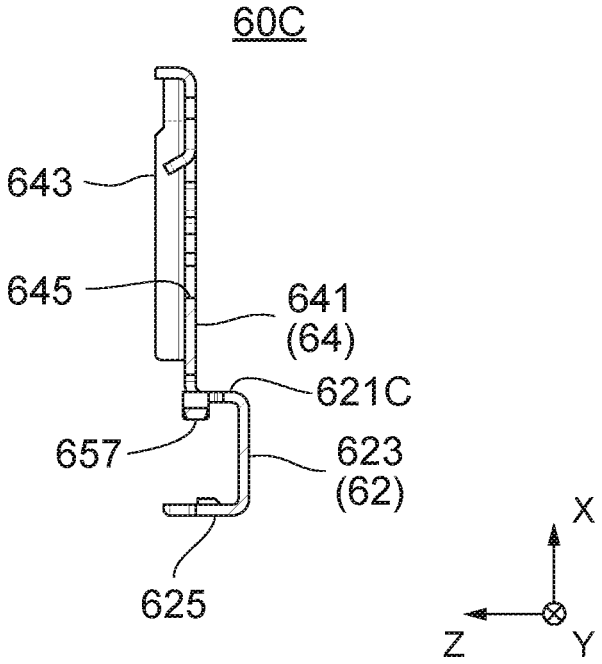
FIG. 39 is a cross-sectional view showing the lower shell of FIG. 37, taken along line I-I.
Figure 40:
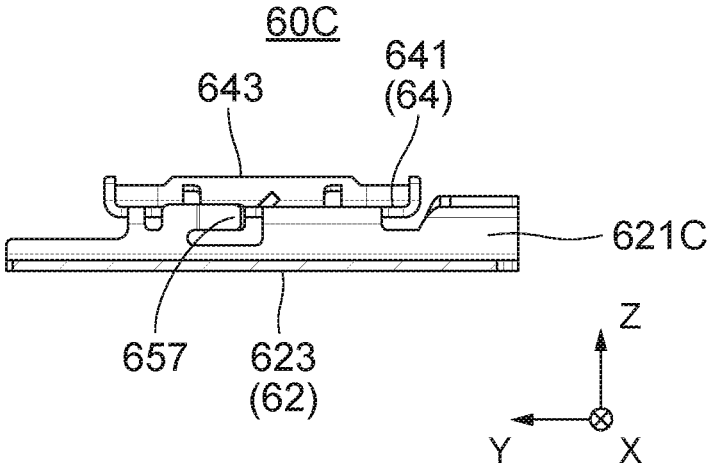
FIG. 40 is a cross-sectional view showing the lower shell of FIG. 37, taken along line J-J.

As understood from FIGS. 35 and 36, the press portion 655 is pressed against the clamp portion 52 when the cable fixing member 50 is attached to the cable receiving portion 62. In this event, the press portion 655 is resiliently deformed and presses the clamp portion 52 by its reaction force. Thus, the outer conductor (or the grounding conductor) 76 (see FIG. 8) of the cable 70 and the lower shell (or the grounding member) 60B are electrically connected to each other through the clamp portion 52. As a result, good signal transmission characteristics can be also obtained in the connector of the present embodiment.

Forth Embodiment

A connector according to a forth embodiment of the present invention is provided with a lower shell 60C shown in FIGS. 37 to 40. Because other points of the connector are same as those of the connector 10 according to the first embodiment, the description of them is omitted.

Referring to FIGS. 37 to 40, the lower shell 60C has a press portion 657 formed to the front plate 621C of the cable receiving portion 62. The press portion 657 is formed by applying cutting and bending processes to the metal sheet forming the lower shell 60C. The press portion 657 is formed as a cantilever and resiliently deformable.

Figure 41:
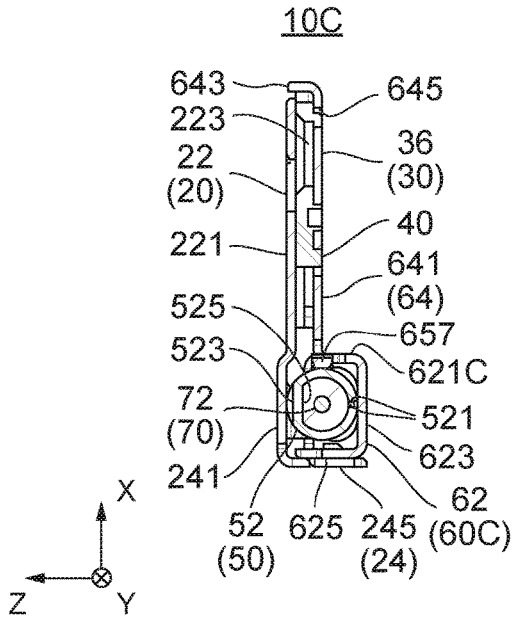
FIG. 41 is a cross-sectional view showing the connector including the lower shell of FIG. 39. The cable is simplified in structure to be shown.
Figure 42:
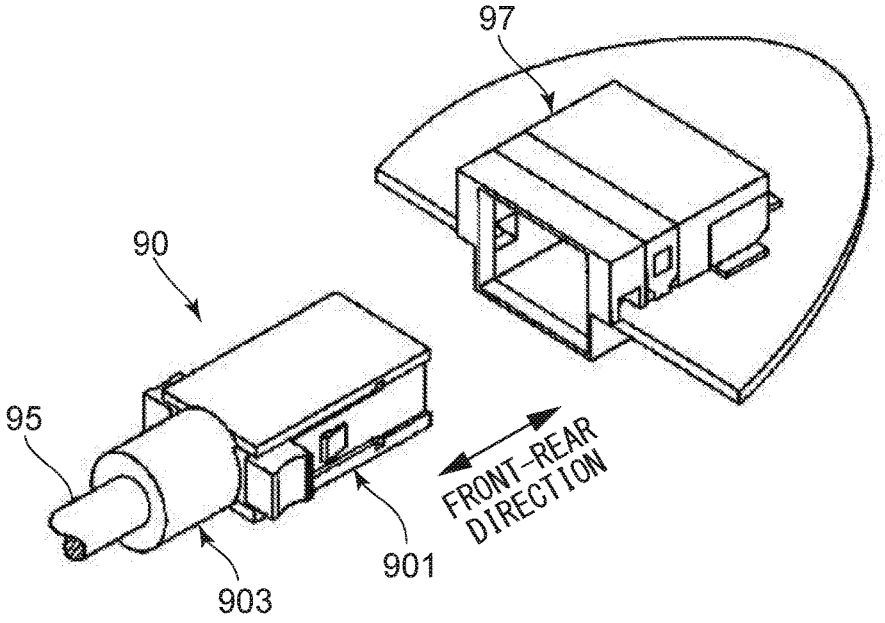
FIG. 42 PRIOR ART
FIG. 42 is a perspective view showing a connector and a mating connector both of which are described in Patent Document 1.

As understood from FIG. 41, the press portion 657 is pressed against the clamp portion 52 when the cable fixing member 50 is attached to the cable receiving portion 62. In this event, the press portion 657 is resiliently deformed and presses the clamp portion 52 by its reaction force. Thus, the outer conductor (or the grounding conductor) 76 (see FIG. 8) of the cable 70 and the lower shell (or the grounding member) 60C are electrically connected to each other through the clamp portion 52. The position of the press portion 657 is nearer to the main plate 641 than the press portion 655 of the connector according to the third embodiment. Accordingly, the path from the outer conductor 76 to the mating grounding contact (or the mating grounding member) 84 can be more shortened. Therefore, better signal transmission characteristics can be obtained.

Although the present invention has been described with reference to preferred embodiments, the present invention is not limited to these. For example, though the connector 10 has the upper shell 20 and the lower shell 60, the present invention may have a single shell (or a grounding member) instead of these.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector which is attachable to a cable having a signal conductor and a grounding conductor and which is mateable with a mating connector having a mating grounding member, wherein:

the connector has a fitting portion and a cable holding portion located rearward of the fitting portion in a front-rear direction;

the connector comprises a grounding member, a signal terminal, a holding member and a cable fixing member;

the signal terminal is to be connected to the signal conductor;

the holding member holds the signal terminal;

the grounding member is attached to the holding member;

the grounding member has a cable receiving portion and a grounding connection portion located forward of the cable receiving portion in the front-rear direction;

the cable receiving portion forms at least a part of the cable holding portion;

the grounding connection portion forms at least a part of the fitting portion;

the grounding connection portion is to be connected to the mating grounding member when the connector is mated with the mating connector;

the cable fixing member has a clamp portion clamping the grounding conductor;

the cable fixing member is fixed to the cable receiving portion;

the cable extends from the cable receiving portion in an intersecting direction intersecting with the front-rear direction;

the cable fixing member connects the grounding conductor to the grounding member; and the clamp portion overlaps with the fitting portion in the intersecting direction.

2. The connector as recited in claim 1, wherein the clamp portion is connected to the cable receiving portion.

3. The connector as recited in claim 2, wherein:

the cable receiving portion protrudes downward from the grounding connection portion in an up-down direction perpendicular to both of the front-rear direction and the intersecting direction; and the clamp portion is connected to the cable receiving portion at a place located downward of the grounding connection portion in the up-down direction.

4. The connector as recited in claim 3, wherein:

the cable receiving portion extends in the intersecting direction and has a cross section with a shape which opens upward in the up-down direction in a surface perpendicular to the intersecting direction; and the clamp portion is connected to a bottom portion of the cable receiving portion.

5. The connector as recited in claim 2, wherein the clamp portion is fixed to the cable receiving portion by welding at a place where the clamp portion is connected to the cable receiving portion.

6. The connector as recited in claim 1, wherein:

the cable fixing member further has a fixed portion; and the fixed portion is fixed to the cable receiving portion.

7. The connector as recited in claim 1, wherein:

the grounding connection portion is positioned upward of the mating grounding member in an up-down direction perpendicular to both of the front-rear direction and the intersecting direction when the connector is mated with the mating connector; and a center of the cable is located downward of a middle of the fitting portion in the up-down direction.

8. The connector as recited in claim 1, wherein:

the grounding connection portion is positioned upward of the mating grounding member in an up-down direction perpendicular to both of the front-rear direction and the intersecting direction when the connector is mated with the mating connector; and the grounding member comprises a lower shell covering a lower side of the holding member at least in part.

9. The connector as recited in claim 8, wherein:

the connector further comprises an upper shell; and the upper shell is combined with the lower shell and covers an upper side of the holding member at least in part.

* * * * *